US012623876B1

(12) United States Patent
Dunbar et al.

(10) Patent No.: US 12,623,876 B1
(45) Date of Patent: May 12, 2026

(54) GEO-STRAP PULLING APPARATUS FOR BUILDING MECHANICALLY STABILIZED EARTH WALLS

(71) Applicants: Shaun Dunbar, Orlando, FL (US); Alejandro Estrella, Orlando, FL (US); Ian Dunbar, Orlando, FL (US)

(72) Inventors: Shaun Dunbar, Orlando, FL (US); Alejandro Estrella, Orlando, FL (US); Ian Dunbar, Orlando, FL (US)

( * ) Notice: Subject to any disclaimer, the term of this patent is extended or adjusted under 35 U.S.C. 154(b) by 0 days.

(21) Appl. No.: 19/098,428

(22) Filed: Apr. 2, 2025

Related U.S. Application Data

(60) Provisional application No. 63/573,227, filed on Apr. 2, 2024.

(51) Int. Cl.
*B65H 18/22* (2006.01)
*B65H 20/16* (2006.01)

(52) U.S. Cl.
CPC ..... *B65H 20/16* (2013.01)

(58) Field of Classification Search
CPC ..... B65H 18/22; B65H 2701/1922; B65H 2301/41429; B65H 20/16; B26D 1/151; B26D 1/185; B26D 1/1435; E01C 23/12; E02F 3/96; E02F 3/3414; Y10T 83/7734; Y10T 83/7793
See application file for complete search history.

(56) References Cited

U.S. PATENT DOCUMENTS 1,274,231 A * 7/1918 Bairs ..... B27G 19/02 83/478
2,462,315 A * 2/1949 Gagne, Jr. ..... B21D 45/00 72/345
3,387,437 A * 6/1968 Owen ..... A01D 46/10 56/13.2
3,481,556 A * 12/1969 Mcdonnell ..... A01G 13/37 242/388.6
3,687,392 A * 8/1972 Parry ..... A01G 13/37 242/596.4
3,715,068 A * 2/1973 Clarke ..... B65H 51/10 226/188
3,750,972 A * 8/1973 Bonnabaud ..... B65H 59/382 242/413.8
3,771,783 A * 11/1973 McInerny ..... B05C 1/04 271/125
3,790,156 A * 2/1974 Hogendyk ..... B65H 45/103 493/415

(Continued)

*Primary Examiner* — Edwin J Toledo-Duran
(74) *Attorney, Agent, or Firm* — Ashkan Najafi

(57) ABSTRACT

A geo-strap pulling apparatus for building mechanically stabilized earth walls includes a frame having a stationary lower section secured to a support surface, a dynamic upper section operably coupled to a stationary lower section, a drive wheel rotatably attached to the frame, a powered actuated implement removably and operably coupled to the drive wheel for spinning the drive wheel about a first fulcrum axis, a driven wheel rotatably attached to the frame and being selectively and operably engaged with the drive wheel for creating a wedge therebetween, and a top handle rotatably attached to a dynamic upper section and being coupled to the driven wheel. The top handle and the dynamic upper section are contemporaneously and selectively pivoted about a second fulcrum axis and configured to adjust a vertical position of the driven wheel relative to the drive wheel.

20 Claims, 7 Drawing Sheets

(56) References Cited

U.S. PATENT DOCUMENTS 3,885,749 A * 5/1975 Skacel ..... B65H 19/2238 242/413.7
3,970,509 A * 7/1976 Vitale ..... B29C 66/73921 228/1.1
3,995,952 A * 12/1976 Schoppe ..... B65H 3/5261 271/34
4,008,891 A * 2/1977 Buys ..... B65H 7/12 271/263
4,033,578 A * 7/1977 Taylor ..... B65H 1/08 271/157
4,084,763 A * 4/1978 Zamboni ..... A01G 13/37 242/399.1
4,090,540 A * 5/1978 Smith ..... A01G 23/091 144/34.1
4,114,530 A * 9/1978 Miller ..... B65B 63/04 53/118
4,162,709 A * 7/1979 Wilson ..... A01G 20/15 172/20
4,344,585 A * 8/1982 Eglinton ..... B65H 18/20 242/541.2
4,354,556 A * 10/1982 Evans ..... A01G 20/18 414/920
4,505,471 A * 3/1985 Stockburger ..... G06K 13/063 271/251
4,542,859 A * 9/1985 Gerstenberger ..... B65H 18/22 242/541.2
4,546,871 A * 10/1985 Duke ..... B65H 33/12 198/418.9
4,726,501 A * 2/1988 Wiley ..... B65H 23/038 226/170
4,765,554 A * 8/1988 Tuffal ..... B65H 27/00 242/541.2
5,011,093 A * 4/1991 Mayer ..... B65H 19/2276 83/279
5,083,517 A * 1/1992 Stevens ..... A01C 7/008 111/104
5,129,462 A * 7/1992 Mail ..... A01G 20/18 242/615.3
5,279,471 A * 1/1994 Peters ..... B65H 19/1863 242/555
5,304,014 A * 4/1994 Slutz ..... B09B 1/004 405/270
5,305,963 A * 4/1994 Harvey, III ..... B65B 63/04 242/541.2
5,425,512 A * 6/1995 Bichot ..... B65B 63/024 242/541.2
5,582,398 A * 12/1996 Long ..... B65H 3/44 271/9.12
5,695,184 A * 12/1997 Miller ..... B65H 3/0607 271/170
5,895,008 A * 4/1999 Sanders ..... B65H 29/008 242/541.2
5,971,311 A * 10/1999 Fujii ..... G03B 17/30 396/513
6,082,660 A * 7/2000 Meyer ..... B65H 35/02 242/615.4
6,109,560 A * 8/2000 Siegel ..... B65H 18/22 100/88
6,112,659 A * 9/2000 Huang ..... B65H 35/0026 101/212
6,123,284 A * 9/2000 Bichot ..... B65H 18/26 242/541.2
6,223,662 B1 * 5/2001 Lastinger ..... A01C 7/008 111/104
6,299,094 B1 * 10/2001 James, Jr. ..... E02B 3/121 242/399.1
6,722,297 B1 * 4/2004 Nelson, Jr. ..... A01C 11/00 111/104
7,100,862 B2 * 9/2006 Skarzenski ..... B30B 9/3082 100/88
7,263,935 B1 * 9/2007 Vandemark ..... A01G 20/12 111/104
7,476,059 B1 * 1/2009 Holland ..... E02D 17/20 405/302.7
8,388,764 B2 * 3/2013 Jonsson ..... A01G 20/00 134/131
8,464,801 B2 * 6/2013 Bearden ..... A01G 20/15 172/20
10,252,437 B2 * 4/2019 Adami ..... B26D 7/1818
11,603,484 B2 * 3/2023 Shinko ..... C08G 18/3206
11,716,941 B2 * 8/2023 Wilson ..... E01C 13/08 172/815
2003/0150953 A1 * 8/2003 Gent ..... E02D 31/004 242/403
2006/0116040 A1 * 6/2006 Yun ..... B29C 48/34 442/49
2010/0314482 A1 * 12/2010 Merkt ..... A01G 20/18 242/557
2012/0031814 A1 * 2/2012 Hinkel ..... E01C 13/08 209/3
2012/0152924 A1 * 6/2012 Christopher ..... B65H 57/12 219/136
2013/0074670 A1 * 3/2013 Albin ..... B24B 27/0007 83/544
2013/0189057 A1 * 7/2013 Motz ..... A01G 20/15 414/501
2013/0240659 A1 * 9/2013 Akpan ..... B65H 18/08 242/548
2014/0037378 A1 * 2/2014 Wilson ..... E02B 11/02 405/36
2014/0326821 A1 * 11/2014 Bishop ..... B26D 1/151 242/522
2015/0166286 A1 * 6/2015 Morris ..... B29B 17/00 242/533.8
2015/0166287 A1 * 6/2015 Van Gurp ..... B65H 18/22 242/535.4
2015/0225195 A1 * 8/2015 Bishop ..... B65H 18/22 242/540
2022/0176862 A1 * 6/2022 Robinson ..... B65H 49/321

* cited by examiner

GEO-STRAP PULLING APPARATUS FOR BUILDING MECHANICALLY STABILIZED EARTH WALLS

CROSS REFERENCE TO RELATED APPLICATIONS

This is a non-provisional patent application that claims priority to and benefit of U.S. provisional patent application No. 63/573,227, filed Apr. 2, 2024, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to building constructions tools and, more particularly, to a specially configured power operated geo-strap pulling apparatus for building mechanically stabilized earth (MSE) walls.

Prior Art

A geo-strap includes closely packed high tenacity polyethylene terephthalate yarns encased in a linear low density polyethylene sheath (LLDPE) and manufactured through a co-extrusion process. A geo-strap is suitable for a large range of soil reinforcement applications, usually with concrete, steel or other material facing panels, such as MSE (mechanically stabilized earth) structures, steep slopes, reinforced embankments and more globally all kind of soil/structure interface systems involving such reinforcements for structures for an extended array of market segments: roads and motorways, environment, railways, hydraulic works, mining, industry, energy, commercial, housing or military. A wide range of physical, chemical, and biological conditions found in reinforced soil structures can be addressed by a geo-strap.

Geo-straps are heavy. Currently, when building a MSE wall, a geo-strap must be manually pulled to a desired location. There are no known current devices to automatically perform this pulling function. Typically, five people are used to pull a geo-strap from one location to another location. Such a limitation increases labor costs and exposes workers to difficult working conditions.

Accordingly, a need remains for a power operated geo-strap pulling apparatus in order to overcome at least one of the above-noted shortcomings. The exemplary embodiment(s) satisfy such a need by a specially configured power operated geo-strap pulling apparatus that is convenient and easy to use, lightweight yet durable in design, versatile in its applications, and configured for building mechanically stabilized earth (MSE) walls.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a specially configured power operated geo-strap pulling apparatus for building mechanically stabilized earth (MSE) walls. These and other objects, features, and advantages of the non-limiting exemplary embodiment(s) are provided by a power operated apparatus that pulls geo-straps used for constructing MSE walls. The apparatus includes a frame having a stationary lower section and a dynamic upper section; a drive (compression) wheel rotatably attached to the frame; a powered (mechanical or electrical) rotating implement preferably having an output of at least 3 amps; an idle (driven) wheel rotatably attached to the frame and selectively and operably engaged against the drive wheel for creating a frictional wedge therebetween; and a top handle attached to the dynamic upper section and operably coupled to the driven wheel, wherein the top handle is selectively pivoted to adjust a position of the driven wheel relative to the drive wheel. The dynamic upper section is configured to allow a geo-strap to be inserted and removed freely between the driven wheel and the drive wheel. The dynamic upper section is selectively locked in an operating position to rotatably engage the driven wheel to the drive wheel and thereby create a frictional force for the pulling the geo-strap therethrough. Advantageously, the frictional force propels the geo-strap from a proximal end of the frame to the distal end thereof when the power implement is operated.

In a non-limiting exemplary embodiment, the apparatus provides increased productivity by streamlining the geo-strap pulling process and allowing for faster completion of the MSE wall installation process. Improved safety is achieved because the apparatus reduces the need for excessive manual labor. Furthermore, the apparatus reduces the risk for labor injuries due to heavy lifting and pulling of these geo-straps. Enhanced ergonomics is realized by minimizing physical strain on the workers and reducing the likelihood of muscular strains and disorders. Versatility is also realized because the machine is adaptable to various construction settings and can accommodate different types and sizes of geo-straps.

Referring generally to the figures, a geo-strap pulling apparatus for building MSE walls. The apparatus includes a frame having a stationary lower section secured to a support surface, wherein the stationary lower section has a central longitudinal axis, a proximal end for receiving a geo-strap, and a distal end for discharging the geo-strap. The apparatus further includes a dynamic upper section operably coupled to the stationary lower section, a drive wheel rotatably attached to the frame, a powered actuated implement removably and operably coupled to the drive wheel for spinning the drive wheel about a first fulcrum axis, a driven wheel rotatably attached to the frame and being selectively and operably engaged with the drive wheel for creating a wedge therebetween, and a top handle rotatably attached to the dynamic upper section and being coupled to the driven wheel. Advantageously, the top handle and the dynamic upper section are contemporaneously and selectively pivoted about a second fulcrum axis and configured to adjust a vertical position of the driven wheel relative to the drive wheel.

In a non-limiting exemplary embodiment, the dynamic upper section is configured to allow the geo-strap to be freely inserted and removed between the drive wheel and the driven wheel.

In a non-limiting exemplary embodiment, the dynamic upper section is selectively locked in an operating position and configured to rotatably engage the driven wheel to the drive wheel and thereby create a frictional force for pulling the geo-strap from the proximal end to the distal end of the frame.

In a non-limiting exemplary embodiment, the frame further includes a non-linear travel path beginning from the proximal end and terminating at the distal end. Such a non-linear travel path passes between the drive wheel and the driven wheel.

In a non-limiting exemplary embodiment, the drive wheel includes a first shaft operably having a first coupling attached thereto. Such a power actuated implement has a second coupling attached thereto and operably affixed to the first coupling for articulating the drive wheel in a desired rotational direction.

In a non-limiting exemplary embodiment, the stationary lower frame includes a guide connected to the proximal end and generally aligned with the central longitudinal axis of the frame.

In a non-limiting exemplary embodiment, the driven wheel includes a second shaft oriented perpendicular to the central longitudinal axis of the frame and parallel to the first shaft.

In a non-limiting exemplary embodiment, the dynamic upper section includes a first support arm having a notch and being registered orthogonal to the central longitudinal axis and further being statically anchored to the stationary lower section, a second support arm rotatably engaged with the second shaft, and a third support arm rotatably engaged with the second shaft and the stationary lower section. Notably, the top handle is connected to the second support arm and the third support arm.

In a non-limiting exemplary embodiment, the second shaft is received within the notch when the driven wheel is frictionally engaged with the drive wheel.

In a non-limiting exemplary embodiment, the second shaft is displaced away from the notch when the driven wheel is pivoted away from the drive wheel.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
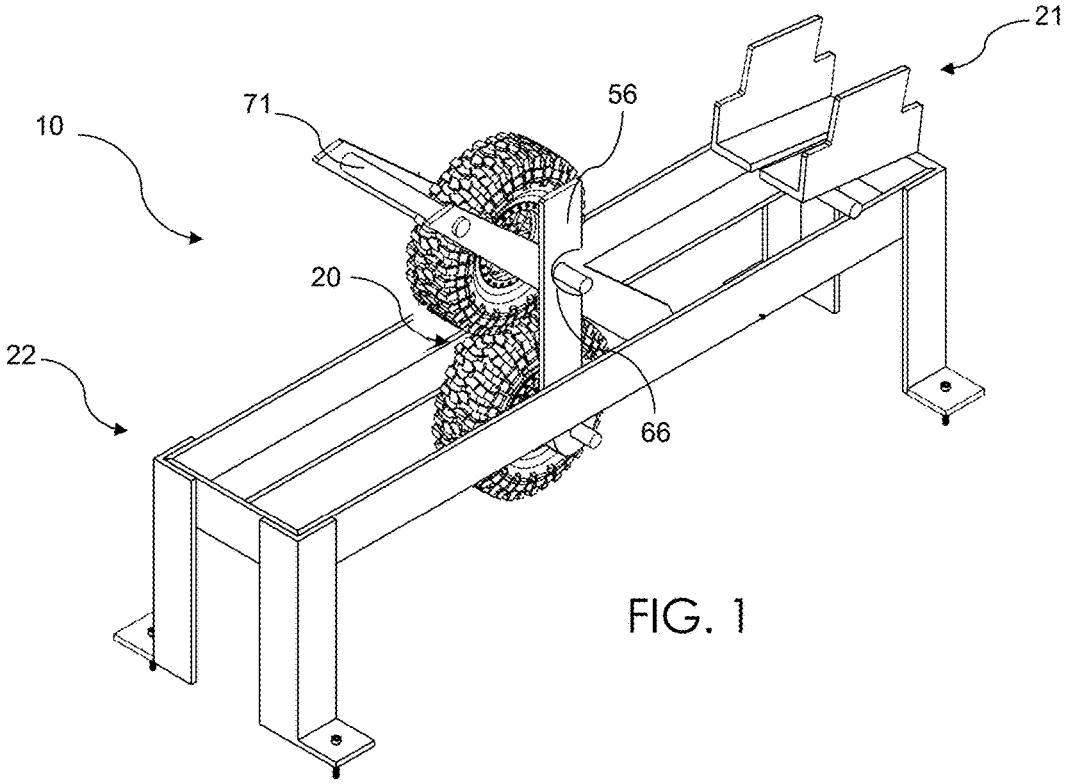
FIG. 1 is a perspective view of a power operated geo-strap pulling apparatus, in accordance with a non-limiting exemplary embodiment of the present disclosure.
Figure 2:
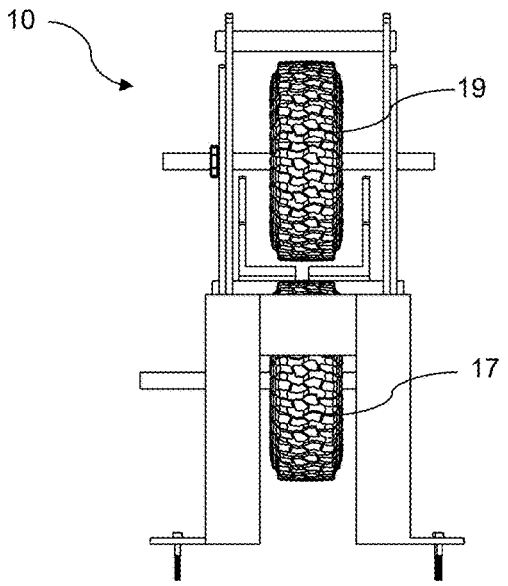
FIG. 2 is a front elevational view of the power operated geo-strap pulling apparatus shown in FIG. 1.
Figure 3:
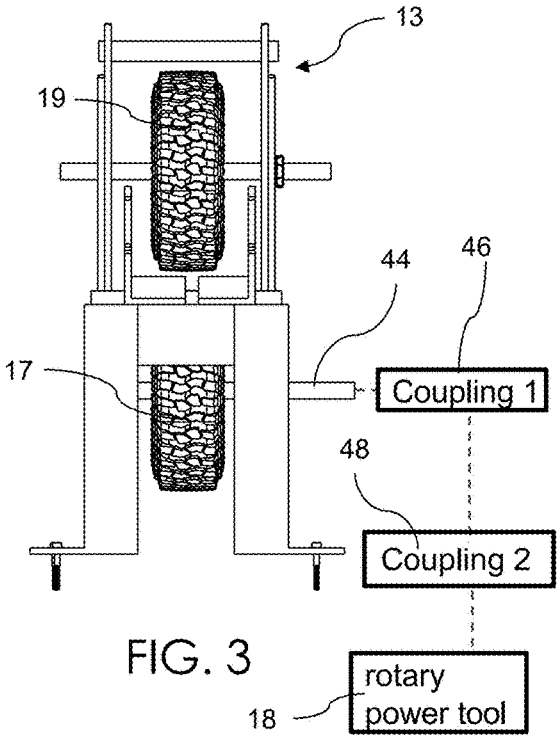
Figure 4:
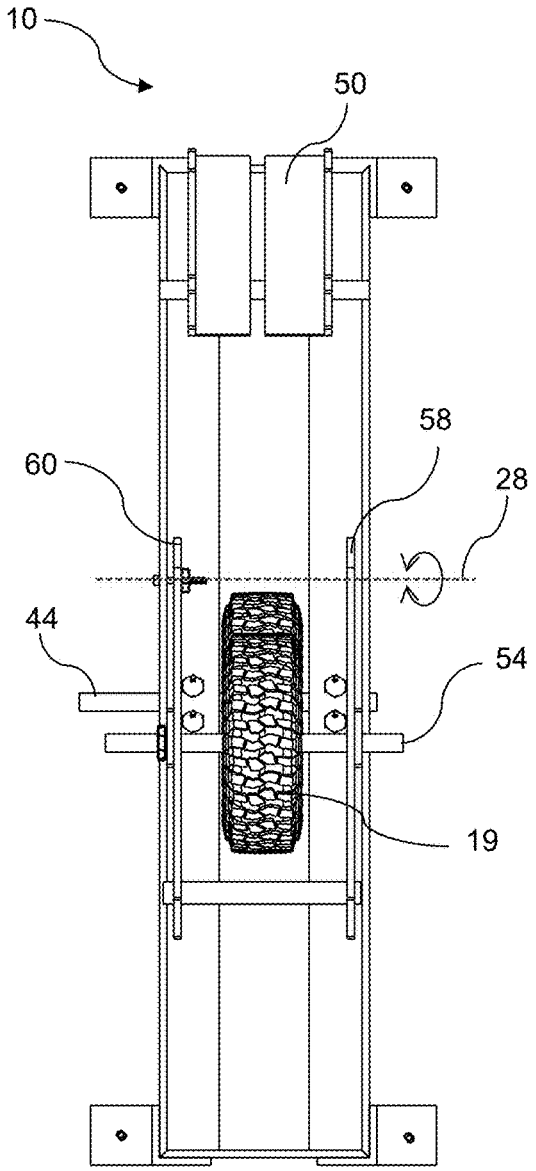
Figure 5:
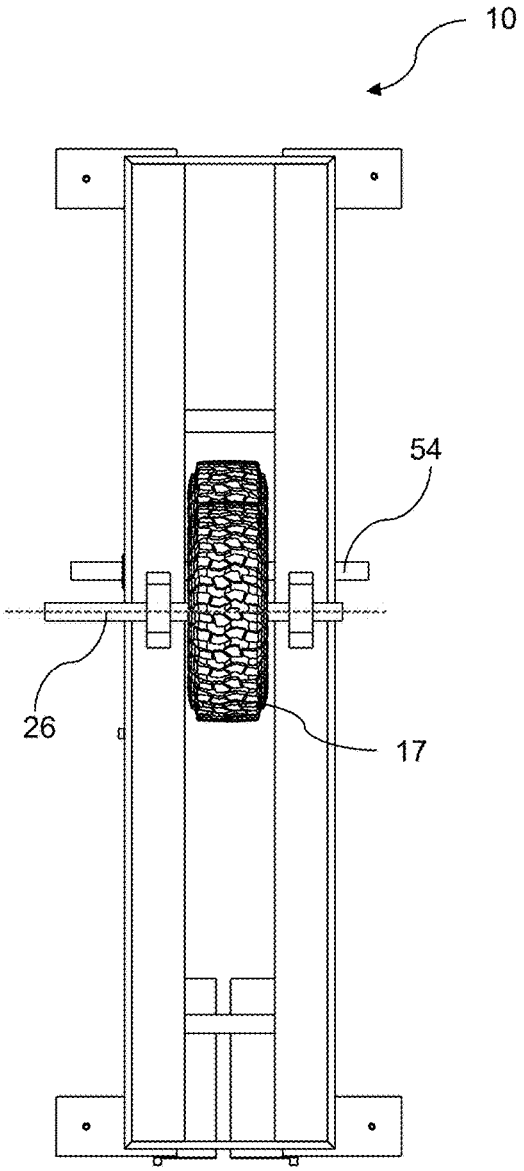
Figure 6:
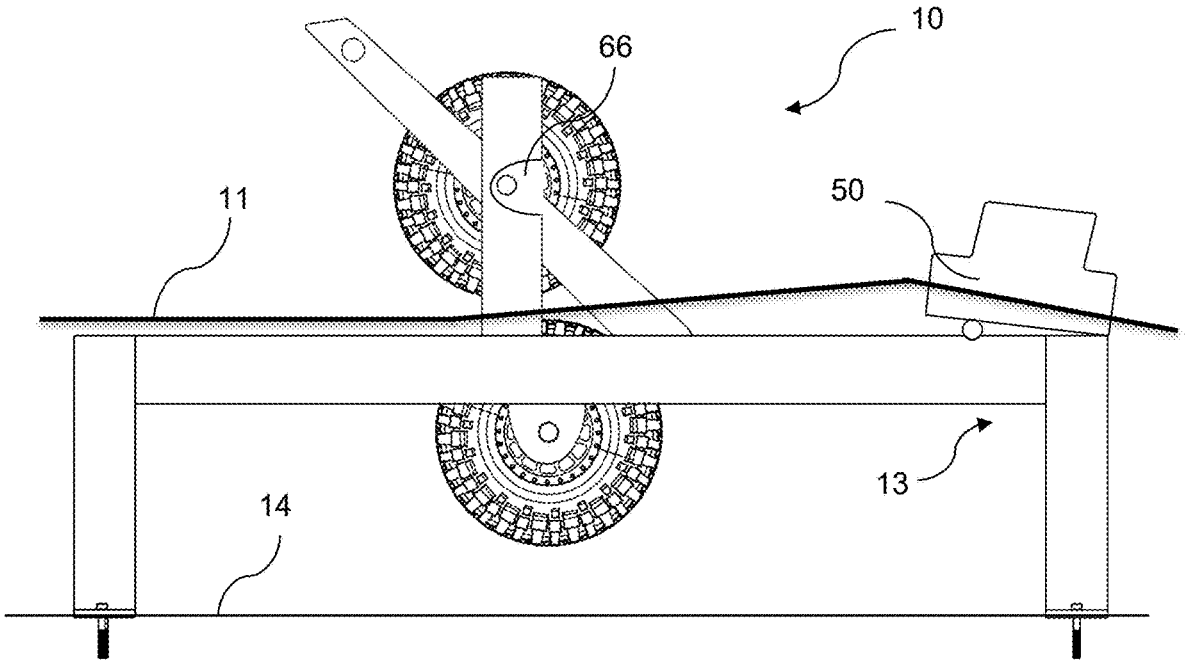
Figure 7:
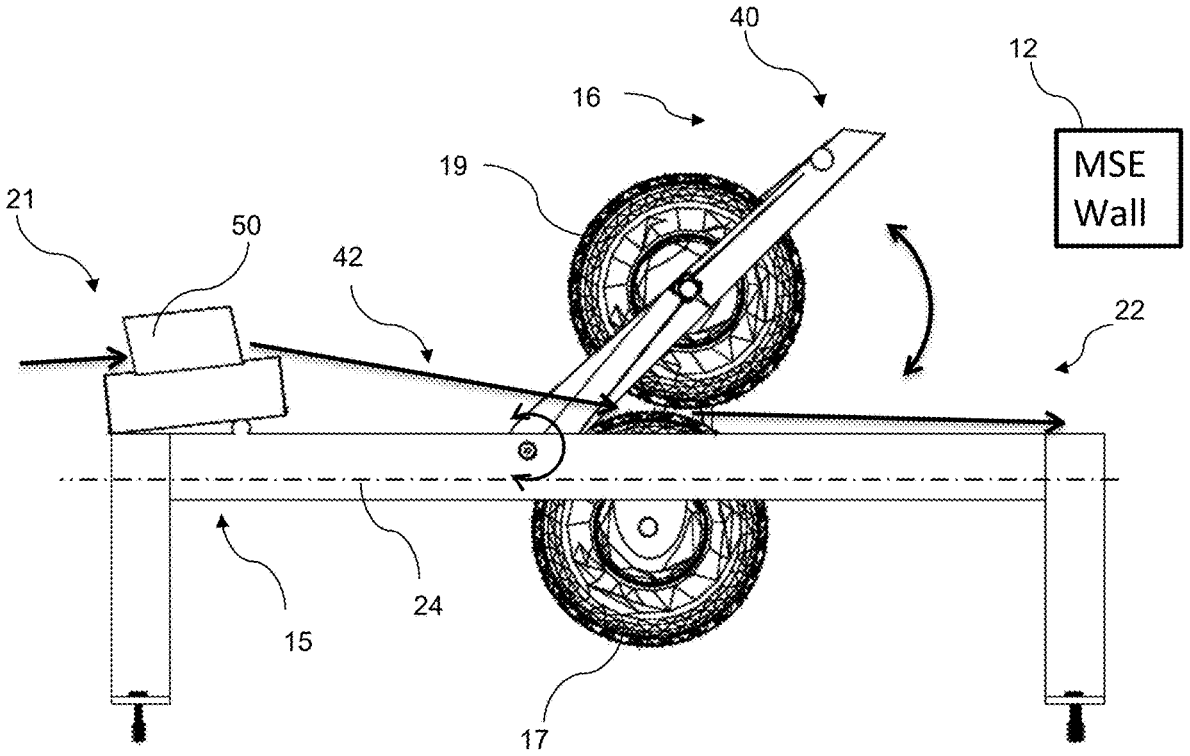
Figure 8:
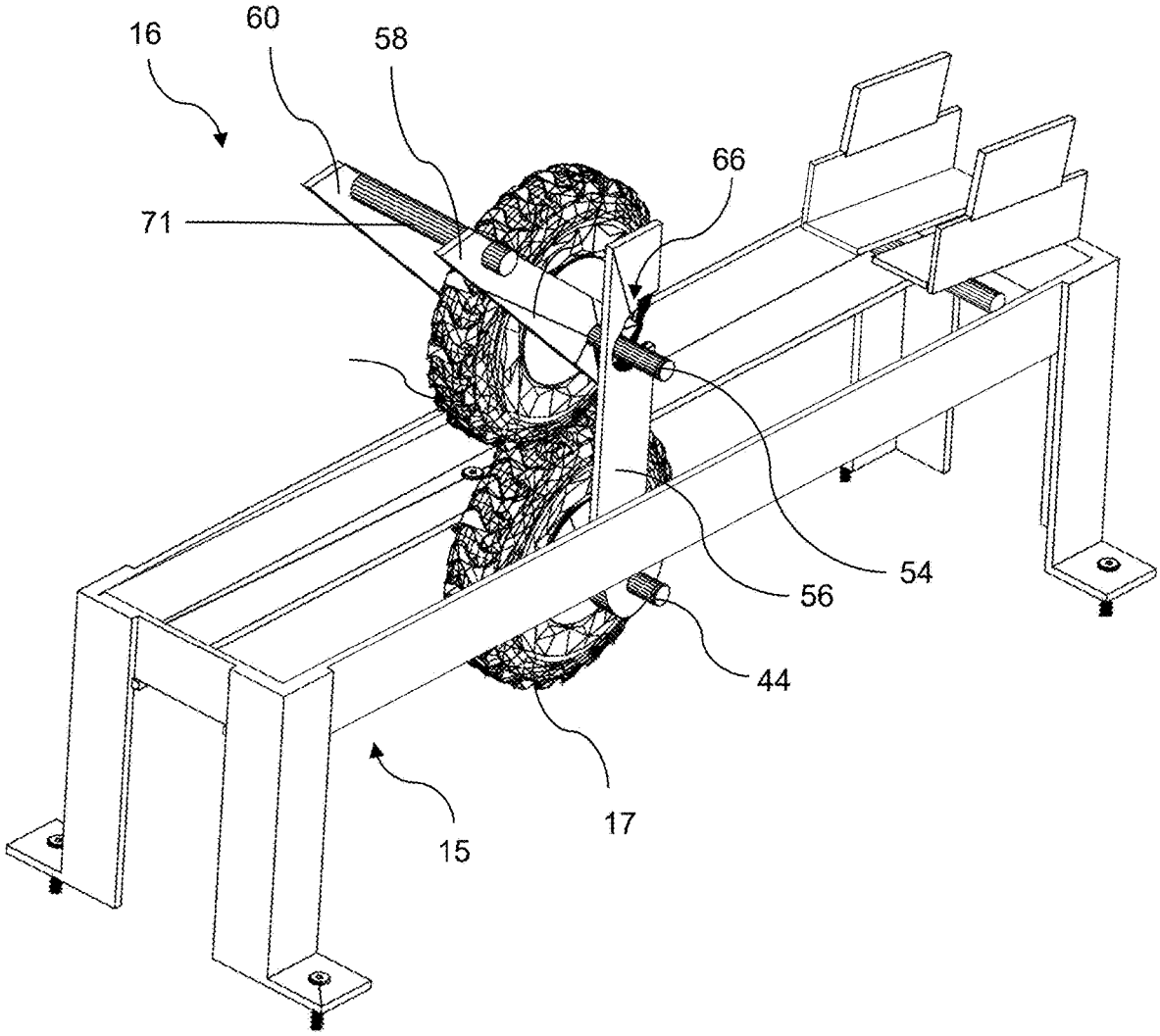
Figure 9:
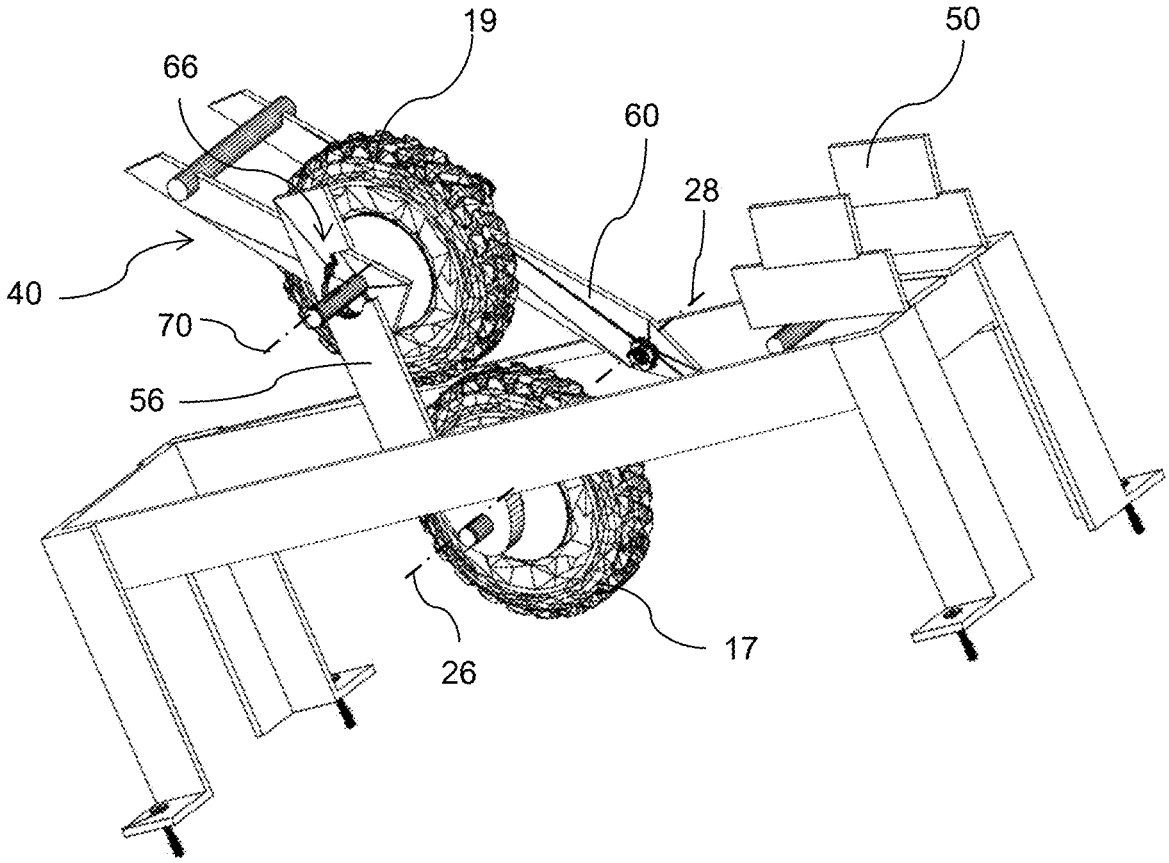
Figure 10:
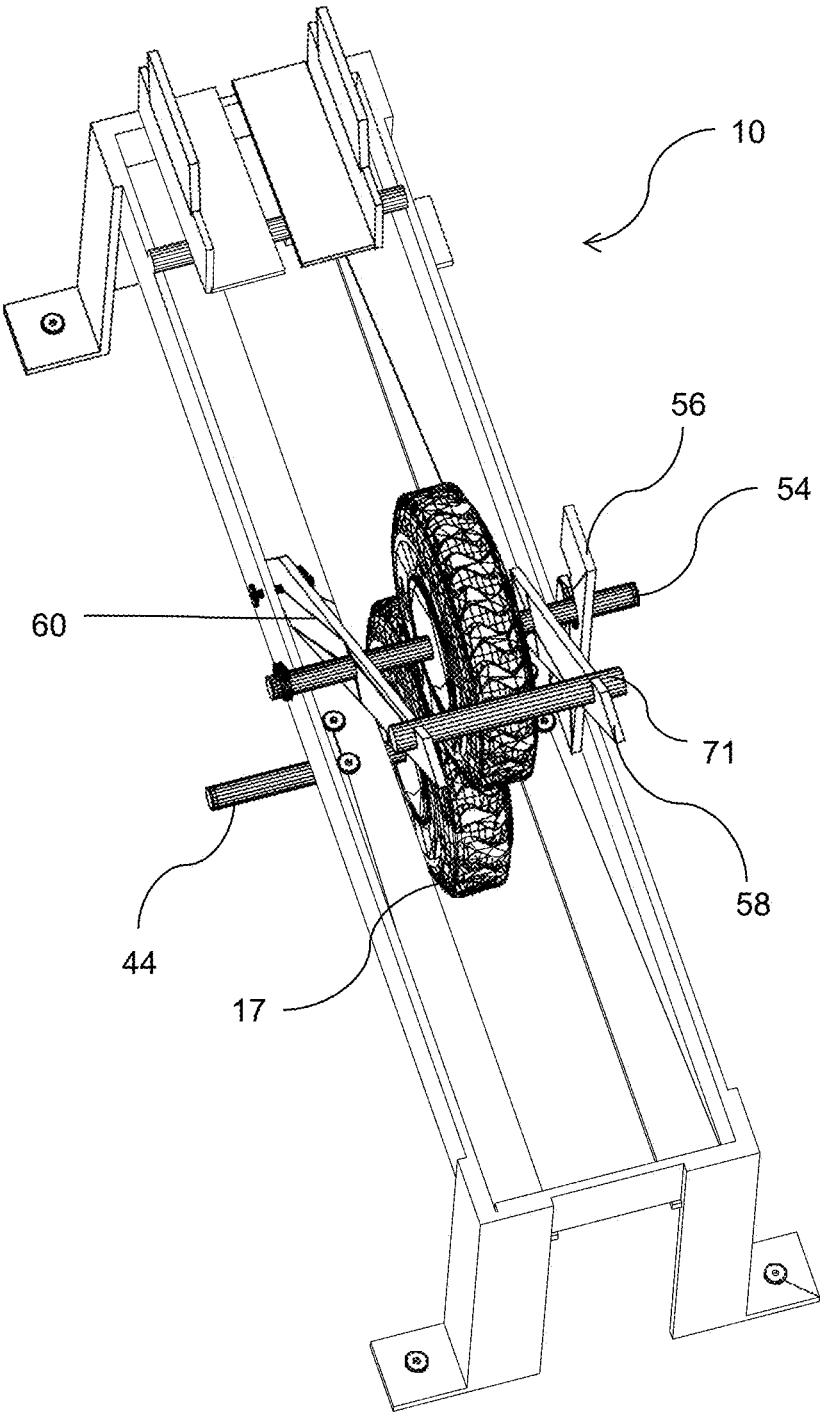

FIG. 3 rear elevational view of the power operated geo-strap pulling apparatus shown in FIG. 1;

FIG. 4 is a top plan view of the power operated geo-strap pulling apparatus shown in FIG. 1;

FIG. 5 is a bottom plan view of the power operated geo-strap pulling apparatus shown in FIG. 1;

FIG. 6 is a right side elevational view of the power operated geo-strap pulling apparatus shown in FIG. 1;

FIG. 7 is a left side elevational view of the power operated geo-strap pulling apparatus shown in FIG. 1;

FIG. 8 is an exploded view of the power operated geo-strap pulling apparatus shown in FIG. 1;

FIG. 9 is another perspective view of the power operated geo-strap pulling apparatus wherein a cutout section permits the driven wheel to be pivoted away from the drive wheel, in accordance with a non-limiting exemplary embodiment of the present disclosure; and FIG. 10 is another perspective view of the power operated geo-strap pulling apparatus showing the interrelationship between the support arms, drive wheel, driven wheel, shafts, and the handle, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-10 and is/are intended to provide a specially configured power operated geo-strap pulling apparatus 10 for building mechanically stabilized earth (MSE) walls 12. It should be understood that the exemplary embodiment(s) may be used to pull a variety of geo-straps 11, and should not be limited to any particular geo-strap 11 described herein.

Referring to FIGS. 1-10 in general, in a non-limiting exemplary embodiment, the apparatus 10 pulls geo-straps 11 used for constructing MSE walls 12. The apparatus 10 includes a free-standing frame 13 configured to be positioned on a support surface 14 (e.g., bed of a pickup truck) and having a stationary lower section 15 and a dynamic upper section 16; a drive (compression) wheel 17 rotatably attached to the frame 13; a powered rotating implement 18 (mechanical (e.g., hand-crank) or electrical (e.g., power drill)) preferably having an output of at least 3 amps; an idle (driven) wheel 19 rotatably attached to the frame 13 and selectively and operably engaged against the drive wheel 17 for creating a frictional wedge 20 therebetween; and a top handle 71 attached to the dynamic upper section 16 and operably coupled to the driven wheel 19, wherein the top handle 71 is selectively pivoted to adjust a position of the driven wheel 19 relative to the drive wheel 17. The dynamic upper section 16 is configured to allow a geo-strap 11 to be inserted and removed freely between the driven wheel 19 and the drive wheel 17. The dynamic upper section 16 is selectively locked in an operating position 40 to rotatably engage the driven wheel 19 to the drive wheel 17 and thereby create a frictional force for the pulling the geo-strap 11 therethrough. Advantageously, the frictional force propels the geo-strap 11 from a proximal end 21 of the frame 13 to the distal end 22 thereof when the power implement 18 is operated. Advantageously, the drive wheel 17 and the driven wheel 19 are elevated above the support surface 14 (e.g., bed of a pickup truck). Such a structural configuration yields the new, useful, and unpredicted result of enabling a user to quickly insert, pull, and release the strap 11 without having to exert as much manual labor.

In a non-limiting exemplary embodiment, the apparatus 10 provides increased productivity by streamlining the geo-strap 11 pulling process and allowing for faster completion of the MSE wall 12 installation process. Improved safety is achieved because the apparatus 10 reduces the need for excessive manual labor. Furthermore, the apparatus 10 reduces the risk for labor injuries due to heavy lifting and pulling of these geo-straps 11. Enhanced ergonomics is realized by minimizing physical strain on the workers and reducing the likelihood of muscular strains and disorders. Versatility is also realized because the machine is adaptable to various construction settings and can accommodate different types and sizes of geo-straps 11.

Referring generally to the figures, a geo-strap pulling apparatus 10 for building MSE walls 12. The apparatus 10 includes a frame 13 having a stationary lower section 15 secured to a support surface 14 (e.g., bed of a pickup truck), wherein the stationary lower section 15 has a central longitudinal axis 24, a proximal end 21 for receiving a geo-strap 11, and a distal end 22 for discharging the geo-strap 11. The apparatus 10 further includes a dynamic upper section 16 operably coupled to the stationary lower section 15, a drive wheel 17 rotatably attached to the frame 13, a powered actuated implement 18 removably and operably coupled to the drive wheel 17 for spinning the drive wheel 17 about a first fulcrum axis 26, a driven wheel 19 rotatably attached to the frame 13 and being selectively and operably engaged with the drive wheel 17 for creating a wedge 20 therebetween, and a top handle 71 rotatably attached to the dynamic upper section 16 and being coupled to the driven wheel 19. Advantageously, the top handle 71 and the dynamic upper section 16 are contemporaneously and selectively pivoted about a second fulcrum axis 28 and configured to adjust a vertical position 30 of the driven wheel 19 relative to the drive wheel 17. It is noted that the shape of the notch 66 may be altered to accommodate the associated shape of the second shaft 54. The driven wheel 19 is rotatable about a third fulcrum axis 70. Such a structural configuration yields the new, useful, and unpredicted result of enabling a user to quickly insert, pull, and release the strap 11 without having to exert as much manual labor.

In a non-limiting exemplary embodiment, the dynamic upper section 16 is configured to allow the geo-strap 11 to be freely inserted and removed between the drive wheel 17 and the driven wheel 19. Such a structural configuration yields the new, useful, and unpredicted result of enabling a user to quickly insert, pull, and release the strap 11 without having to exert as much manual labor.

In a non-limiting exemplary embodiment, the dynamic upper section 16 is selectively locked in an operating position 40 and configured to rotatably engage the driven wheel 19 to the drive wheel 17 and thereby create a frictional force for pulling the geo-strap 11 from the proximal end 21 to the distal end 22 of the frame 13. Such a structural configuration yields the new, useful, and unpredicted result of enabling a user to quickly insert, pull, and release the strap 11 without having to exert as much manual labor.

In a non-limiting exemplary embodiment, the frame 13 further includes a non-linear travel path 42 beginning from the proximal end 21 and terminating at the distal end 22. Such a non-linear travel path 42 passes between the drive wheel 17 and the driven wheel 19. Such a structural configuration yields the new, useful, and unpredicted result of enabling a user to quickly insert, pull, and release the strap 11 without having to exert as much manual labor.

In a non-limiting exemplary embodiment, the drive wheel 17 includes a first shaft 44 operably having a first coupling 46 attached thereto. Such a power actuated implement 18 has a second coupling 48 attached thereto and operably affixed to the first coupling 46 for articulating the drive wheel 17 in a desired rotational direction. Such a structural configuration yields the new, useful, and unpredicted result of enabling a user to quickly insert, pull, and release the strap 11 without having to exert as much manual labor.

In a non-limiting exemplary embodiment, the stationary lower frame 13 includes a guide 50 connected to the proximal end 21 and generally aligned with the central longitudinal axis 24 of the frame 13. Such a structural configuration yields the new, useful, and unpredicted result of enabling a user to quickly insert, pull, and release the strap 11 without having to exert as much manual labor.

In a non-limiting exemplary embodiment, the driven wheel 19 includes a second shaft 54 oriented perpendicular to the central longitudinal axis 24 of the frame 13 and parallel to the first shaft 44. Such a structural configuration yields the new, useful, and unpredicted result of enabling a user to quickly insert, pull, and release the strap 11 without having to exert as much manual labor.

In a non-limiting exemplary embodiment, the dynamic upper section 16 includes a first support arm 56 having a notch 66 and being registered orthogonal to the central longitudinal axis 24 and further being statically anchored to the stationary lower section 15, a second support arm 58 rotatably engaged with the second shaft 54, and a third support arm 60 rotatably engaged with the second shaft 54 and the stationary lower section 15. Notably, the top handle 71 is connected to the second support arm 58 and the third support arm 60. Such a structural configuration yields the new, useful, and unpredicted result of enabling a user to quickly insert, pull, and release the strap 11 without having to exert as much manual labor.

In a non-limiting exemplary embodiment, the second shaft 54 is received within the notch 66 when the driven wheel 19 is frictionally engaged with the drive wheel 17. Such a structural configuration yields the new, useful, and unpredicted result of enabling a user to quickly insert, pull, and release the strap 11 without having to exert as much manual labor.

In a non-limiting exemplary embodiment, the second shaft 54 is displaced away from the notch 66 when the driven wheel 19 is pivoted away from the drive wheel 17. Such a structural configuration yields the new, useful, and unpredicted result of enabling a user to quickly insert, pull, and release the strap 11 without having to exert as much manual labor.

In a non-limiting exemplary embodiment, the apparatus 10 includes a drive wheel 17 that is connected to a mechanical or electrical rotating device (e.g., rotating handle 71, power drill, etc.). A driven (idle) wheel 19 is pressed against the drive wheel 17 and thereby creates a wedge 20 between the driven wheel 19 and drive wheel 17. A pivotal top handle 71 holds the drive wheel 17 in proximity to the driven wheel 19. Such a top handle 71 advantageously allows the straps to be inserted and removed freely while passing between the lower drive wheel 17 and upper driven wheel 19. A lower portion of the frame 13 supports the drive wheel 17 and is fixed, such that when an upper portion of the frame 13 with the driven wheel 19 is pivoted towards the lower drive wheel 17, a frictional force is created for pulling the geo-strap 11 between the drive wheel 17 and the driven wheel 19. This frictional contact is used as the propulsion force to displace the strap 11 from one end of the apparatus 10 to the opposite end thereof.

In a non-limiting exemplary embodiment, the mechanical or electrical rotating device is preferably greater than three amps (e.g., power drill) and has a second coupling 48 configured to operably engage a first coupling 46 at the drive wheel 17 shaft.

In a non-limiting exemplary embodiment, the apparatus 10 provides increased productivity and streamlines the geo-strap 11 pulling process, thereby allowing for faster completion of the MSE Wall 12 installation process. The apparatus 10 also improves safety by reducing the need for excessive manual labor. The apparatus 10 reduces the risk of labor injuries caused by heavy lifting and pulling of these geo-straps 11. The apparatus 10 has enhanced ergonomics by minimizing physical strain on the workers, thereby reducing the likelihood of muscular strains and disorders. The apparatus 10 is adaptable to various construction settings and can accommodate different types and sizes of geo-straps 11.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A geo-strap pulling apparatus for building mechanically stabilized earth (MSE) walls, comprising:

a frame having a stationary lower section secured to a support surface, said stationary lower section having a central longitudinal axis, a proximal end configured to receive a geo-strap from an exterior of said frame, and a distal end configured to discharge the geo-strap at an unwound configuration; and a dynamic upper section operably coupled to said stationary lower section;

a drive wheel rotatably attached to said frame;

a powered actuated implement removably and operably coupled to said drive wheel for spinning said drive wheel about a first fulcrum axis;

a driven wheel rotatably attached to said frame and being selectively and operably engaged with said drive wheel for creating a wedge therebetween; and a top handle rotatably attached to said dynamic upper section and being directly coupled to said driven wheel, wherein said top handle and said dynamic upper section are contemporaneously and selectively pivoted about a second fulcrum axis and configured to adjust a vertical position of said driven wheel relative to said drive wheel;

wherein said powered actuated implement is portable and hand-operated and located externally of said frame;

wherein said top handle remains spaced from the geo-strap;

wherein said second fulcrum axis is located approximately midway between said proximal end and said distal end of said frame.

2. The geo-strap pulling apparatus of claim 1, wherein said dynamic upper section is configured to allow the geo-strap to be freely inserted and removed between said drive wheel and said driven wheel.

3. The geo-strap pulling apparatus of claim 1, wherein said dynamic upper section is selectively locked in an operating position and configured to rotatably engage said driven wheel to said drive wheel and thereby create a frictional force for pulling the geo-strap from said proximal end to said distal end of said frame.

4. The geo-strap pulling apparatus of claim 1, wherein said frame further includes a non-linear travel path beginning from said proximal end and terminating at said distal end, said non-linear travel path passing between said drive wheel and said driven wheel.

5. The geo-strap pulling apparatus of claim 1, wherein said drive wheel comprises: a first shaft operably having a first coupling attached thereto, said power actuated implement having a second coupling attached thereto and being operably affixed to said first coupling for articulating said drive wheel in a desired rotational direction.

6. The geo-strap pulling apparatus of claim 1, wherein said stationary lower frame comprises: a guide connected to said proximal end and generally aligned with the central longitudinal axis of said frame.

7. The geo-strap pulling apparatus of claim 5, wherein said driven wheel comprises: a second shaft oriented perpendicular to the central longitudinal axis of said frame and parallel to said first shaft.

8. The geo-strap pulling apparatus of claim 7, wherein said dynamic upper section comprises:

a first support arm having a notch and being registered orthogonal to the central longitudinal axis and further being statically anchored to said stationary lower section;

a second support arm rotatably engaged with said second shaft; and a third support arm rotatably engaged with said second shaft and said stationary lower section;

wherein said top handle is connected to said second support arm and said third support arm.

9. The geo-strap pulling apparatus of claim 8, wherein said second shaft is received within said notch when said driven wheel is frictionally engaged with said drive wheel.

10. The geo-strap pulling apparatus of claim 8, wherein said second shaft is displaced away from said notch when said driven wheel is pivoted away from said drive wheel.

11. A geo-strap pulling apparatus for building mechanically stabilized earth (MSE) walls, comprising:

a free-standing frame having a stationary lower section secured to a support surface, said stationary lower section having a central longitudinal axis, a proximal end configured to receive a geo-strap from an exterior of said frame, and a distal end configured to discharge the geo-strap at an unwound configuration; and a dynamic upper section operably coupled to said stationary lower section;

a drive wheel rotatably attached to said frame;

a powered actuated implement removably and operably coupled to said drive wheel for spinning said drive wheel about a first fulcrum axis;

a driven wheel rotatably attached to said frame and being selectively and operably engaged with said drive wheel for creating a wedge therebetween; and a top handle rotatably attached to said dynamic upper section and being directly coupled to said driven wheel, wherein said top handle and said dynamic upper section are contemporaneously and selectively pivoted about a second fulcrum axis and configured to adjust a vertical position of said driven wheel relative to said drive wheel;

wherein said powered actuated implement is portable and hand-operated and located externally of said frame;

wherein said top handle remains spaced from the geo-strap;

wherein said second fulcrum axis is located approximately midway between said proximal end and said distal end of said frame.

12. The geo-strap pulling apparatus of claim 11, wherein said dynamic upper section is configured to allow the geo-strap to be freely inserted and removed between said drive wheel and said driven wheel.

13. The geo-strap pulling apparatus of claim 11, wherein said dynamic upper section is selectively locked in an operating position and configured to rotatably engage said driven wheel to said drive wheel and thereby create a frictional force for pulling the geo-strap from said proximal end to said distal end of said frame.

14. The geo-strap pulling apparatus of claim 11, wherein said frame further includes a non-linear travel path beginning from said proximal end and terminating at said distal end, said non-linear travel path passing between said drive wheel and said driven wheel.

15. The geo-strap pulling apparatus of claim 11, wherein said drive wheel comprises: a first shaft operably having a first coupling attached thereto, said power actuated implement having a second coupling attached thereto and being operably affixed to said first coupling for articulating said drive wheel in a desired rotational direction.

16. The geo-strap pulling apparatus of claim 11, wherein said stationary lower frame comprises: a guide connected to said proximal end and generally aligned with the central longitudinal axis of said frame.

17. The geo-strap pulling apparatus of claim 15, wherein said driven wheel comprises: a second shaft oriented perpendicular to the central longitudinal axis of said frame and parallel to said first shaft.

18. The geo-strap pulling apparatus of claim 17, wherein said dynamic upper section comprises:

a first support arm having a notch and being registered orthogonal to the central longitudinal axis and further being statically anchored to said stationary lower section;

a second support arm rotatably engaged with said second shaft; and a third support arm rotatably engaged with said second shaft and said stationary lower section;

wherein said top handle is connected to said second support arm and said third support arm.

19. The geo-strap pulling apparatus of claim 18, wherein said second shaft is received within said notch when said driven wheel is frictionally engaged with said drive wheel; wherein said second shaft is displaced away from said notch when said driven wheel is pivoted away from said drive wheel.

20. A geo-strap pulling apparatus for building mechanically stabilized earth (MSE) walls, comprising:

a free-standing frame configured to be positioned on a support surface and having a stationary lower section secured to the support surface, said stationary lower section having a central longitudinal axis, a proximal end configured to receive a geo-strap from an exterior of said frame; and a distal end configured to discharge the geo-strap at an unwound configuration; and a dynamic upper section operably coupled to said stationary lower section;

a drive wheel rotatably attached to said frame;

a powered actuated implement removably and operably coupled to said drive wheel for spinning said drive wheel about a first fulcrum axis;

a driven wheel rotatably attached to said frame and being selectively and operably engaged with said drive wheel for creating a wedge therebetween; and a top handle rotatably attached to said dynamic upper section and being directly coupled to said driven wheel, wherein said top handle and said dynamic upper section are contemporaneously and selectively pivoted about a second fulcrum axis and configured to adjust a vertical position of said driven wheel relative to said drive wheel;

wherein said drive wheel and said driven wheel are elevated above the support surface;

wherein said powered actuated implement is portable and hand-operated and located externally of said frame;

wherein said top handle remains spaced from the geo-strap;

wherein said second fulcrum axis is located approximately midway between said proximal end and said distal end of said frame.

* * * * *